US005199627A

United States Patent [19]

Christensen

[11] Patent Number: 5,199,627

[45] Date of Patent: Apr. 6, 1993

[54] SELF POWERED MAGAZINE HAMMER

[76] Inventor: Jeffrey M. Christensen, 10359 Wilsey Ave., Tujunga, Calif. 91042

[21] Appl. No.: 678,534

[22] Filed: Mar. 29, 1991

[51] Int. Cl.[5] ..... B27F 7/09

[52] U.S. Cl. ..... 227/130; 227/133

[58] Field of Search ..... 227/133, 147, 130; 81/DIG. 12, 20, 23

[56] References Cited

U.S. PATENT DOCUMENTS

| | | | |
|---|---|---|---|
| 2,193,143 | 3/1940 | Rapien | 227/133 |
| 2,537,601 | 1/1951 | Peterson | 227/133 |
| 2,552,798 | 5/1951 | Lindstrom | 227/133 |
| 2,624,047 | 1/1953 | Gaskill | 227/133 |
| 4,363,344 | 12/1982 | Pollak | 81/20 |
| 4,882,955 | 11/1989 | Savnik | 81/20 |
| 4,882,956 | 11/1989 | Lang | 81/20 |

FOREIGN PATENT DOCUMENTS

| | | | |
|---|---|---|---|
| 494122 | 10/1938 | United Kingdom | 227/133 |

*Primary Examiner*—Douglas D. Watts
*Assistant Examiner*—Rinaldi Rada
*Attorney, Agent, or Firm*—Wagner & Middlebrook

[57] ABSTRACT

A hammer including a magazine for holding and feeding fasteners such as nails including hydraulic means for driving the fasteners. The hammer head is movable to the rearward with respect to the body and the handle upon impacting a work surface driving one or more pistons rearwardly. Cylinders for the pistons surround a single fastener driver cylinder and piston of smaller surface area than rearward traveling piston or pistons. Hydraulic fluid flows from the large or multiple piston(s) through a manifold to the rear of the fastener drive cylinder piston. Rapid forward movement of the fastener drive piston sets the fastener. Forward movement of the movable head by a return spring opens a chamber for the next fastener to be placed by spring action in front of the fastener drive blade, ready for the next fastener placement. The body of the hammer is secured to the handle at an angle A which is between 95° and 116° and the center of gravity of the hammer is located between at handle location ±10% of the distance from the handle to the normal line through the head in its ready-to-fasten position.

18 Claims, 4 Drawing Sheets

SELF POWERED MAGAZINE HAMMER

BACKGROUND OF THE INVENTION

The hammer for driving nail-like fasteners goes back in history to timeless eras of the past and has basically remained unchanged through the years in its basic form. Recent discoveries of hammer heads dating to the bronze age bear a striking resemblance to modern day hammers. Of course, specialized hammers have been developed for special purposes, e.g., upholstery hammers, framing hammers, roofing hammers, chipping hammers and the like but they all have the basic attributes of a weighted head, a fastener driving surface and a convenient handle at right angles with respect to the head and generally parallel to the fastener driving surface.

In recent years there has developed wide acceptance for pneumatically driven fasteners such as nails and staples and in such case, the hammering device may take on the appearance of a stapler, a handgun or specialized shapes for this specialized form of fasteners.

The use of pneumatic powered fastener driving devices has always presented a problem of requiring a pneumatic gas supply under pressure which is usually provided by an air compressor, storage tank and hose line to the driving device. Also, pressure regulators and valves are necessitated for an effective pneumatic driving device.

I have been familiar with the various types of manual and pneumatic fastener drivers and have seen the various types of fasteners used (i.e., nails, screws, staples, etc.). One important advantage of the pneumatic device is that with a continuous source of pneumatic pressure, fastening can be in a virtually continuous basis as when a magazine is included in the tool capable of storing quantities of fasteners. Typically, manual hammers have not provided for multiple fasteners storage and feeding. Also, conventional hammers with the exception of magnetic head tack hammers seldom have the capability of holding the fastener prior to nailing.

In the roofing operation for residences, the hammer must drive a large headed roofing nail through a sheet of sub roofing and one or more thicknesses of wood or composition roof shingles. The nail must be driven straight, leaving no visible bump through the next succeeding layer and must enter a hold well in a somewhat resilient (unbacked by framing at most locations) surface.

In my study of fastener driving needs, I have encountered one additional particularly troublesome operation, namely, the driving of drywall nails into paper covered plaster-like (Gypsum) construction board used for interiors of residences and some commercial structures and commonly referred to as drywall or sheetrock.

Drywall commonly comes in 4'×10' or 4'×12' sheets which must be placed and held in place while being secured, including overhead to the ceilings. The number of fasteners required to attach a single sheet of sheetrock can be as many as 60. Additionally, each drywall nail has a cupped head so as not to penetrate through the drywall paper covering and must be dimpled when it is set. By dimpling it is meant in the trade that the cupped head, for example, is driven below the outer surface of the drywall compressing the exposed paper without destroying its integrity with only a hole the size of the shank of the nail penetrating the plaster-like body of the drywall. The dimple must be broader than the head and may be as large as 1" to 1½" in diameter. After the drywall nail has been driven, a further surface treatment step of troweling on a surface compound to fill the dimpling to the level of the uncompressed drywall surface must be accomplished. A material commonly referred to as surfacing compound or "mud" adheres well to the paper surface and covers the head of the drywall nail.

Recently, there has been a trend toward the use of threaded or drywall screws which have a lesser tendency to "pop" when the underlying wood dries or moves after the drywall surface has been placed and finished. Drywall screws, however, are expensive-much more so than the most common drywall nail and considering the fact that a multitude of fasteners are needed for a single sheet of sheetrock of the interior of the residence, using the more expensive drywall screws can have a significant cost impact.

I viewed this state of the art as one which presents a very real need for a self contained hammer which does not require any pneumatic source, which does hold each individual nail for driving, and which does hold a supply of nails and automatically feeds each nail so that no handling of each individual nail is required. I also recognized the need that such a hammer can be a boon to roofers, carpenters in general and, particularly, the drywall installer if it can meet their particular requirements.

In virtually all non-powdered fastener settings with the exception of staples, nail magazines, or nail holders have not met tradesmen's acceptance.

I have reviewed the prior art found in searching and the following illustrate prior attempts to improve hammers.

| | | |
|---|---|---|
| 293,516 | A. POTTER | 02/12/1884 |
| 362,224 | N. NEWMAN | 05/03/1887 |
| 917,291 | M. HAMMER | 04/06/09 |
| 932,211 | W. WIELAND | 08/24/09 |
| 1,488,161 | C. MCCORMICK | 03/25/24 |
| 2,113,084 | J. HEWITT | 04/05/38 |
| 2,193,143 | L. RAPIEN | 03/12/40 |
| 2,238,983 | J. ABRAHAMSEN | 03/08/66 |
| 2,667,639 | E. SCHICK | 02/02/54 |
| 2,893,279 | P. HASKELL | 07/07/59 |
| 3,180,550 | I. BOYNTON | 04/27/65 |
| 3,602,419 | M. DOBERNE | 08/31/71 |
| 4,341,336 | G. SMITH | 07/27/82 |
| 4,434,929 | N. KEENER | 03/06/84 |
| 4,448,339 | R. PETTIGREW | 05/15/84 |
| 4,566,619 | E. KLEINHOLZ | 01/28/86 |
| 4,611,739 | D. ROWTON | 09/16/86 |
| 4,676,424 | A. MEADOR | 06/30/87 |
| 4,714,186 | R. WILLIAMSON | 12/22/87 |
| 4,742,875 | J. BELL | 05/10/88 |
| 4,796,495 | A. SCHAR | 01/10/89 |
| 4,831,901 | A. KINNE | 05/23/89 |
| 4,838,471 | D. CHIESA | 06/13/89 |

BRIEF DESCRIPTION OF THE INVENTION

Faced with the foregoing state of the art and the needs which I recognized, I have invented just such a hammer which is designed to be self contained, have the same general shape as a conventional hammer with a weight and balance acceptable to tradesmen and which accomplishes each of the desired objectives described above.

In the preferred embodiment of my invention, the hammer head includes a fixed body secured to a fixed handle but includes a moving head. The moving head is, in fact, connected to a piston held in an outward position by internal springs against a stop in the said head body.

The moving head is different from conventional hammers in that it includes a central aperture through which nails are driven and a side or bottom opening for receiving sequentially placed nails from a magazine affixed to the hammer. Positioned behind a chamber, which is analogous to a firearm chamber, is a nail drive blade and piston having sufficient travel to allow the driving of the fasteners used. A maximum travel of 2 inches is recommended. The body is hollow and, in addition to positioning the movable head, includes at least one manifold communicating with a plurality of cylinders, each with a longitudinally extending piston coupled to the rear or inner face of the moving head. The total surface area of the pistons at the rear of the moving head is larger than, and in the preferred embodiment, several times larger than the piston head area of the drive blade. Whenever the moving head is driven rearward by a blow, the drive blade travels forward in the opposite direction of the movement of the moving head for distance approximating the ratio of the areas of the moving head pistons and the drive blade piston. Sealing means is provided between the moving head and the hammer body and between the piston and the moving head. The manifold at the rear of the hammer head is filled with hydraulic fluid.

A spring driven nail magazine is secured to the hammer for taking strips of nails and positioning them for sequentially placing them in the chamber.

In the development of this invention, I also discovered that contrary to accepted belief that the driving head surface of a hammer should be normal, i.e. at 90° with respect to the axis of the handle, instead, an angle of 95° to 116° measured from the longitudinal axis of the body 12 is more efficient. Given a length of handle of 9" to 11" for typical hammer in the 12" to 16" variety and a typical arm length from elbow to center of grip for an adult male of 11" to 15", the 95° to 116° angle provides a direct driving force without danger of workpiece damage as commonly occurs with conventional hammers. Since the nail is delivered through the center of the moving head, this angle allows the head to hit the work surface at approximately a 90° angle and, of equal importance the nail to enter the workpiece at approximately a 90° angle.

One of the features of my invention is the fully arm powered nailer with through the head nailing.

Another feature is a hammer with a handle head combination in which the head joins the handle at an angle of between 95° and 116°.

Still another feature of this invention is the combination of an apertured moving head in a manually operated hammer in which the moving head uses hydraulic pressure induced by its movement in the hammer body to produce driving force for a nail positioned and driven through the apertured head.

One other feature of my invention involves the longitudinally apertured head having a side or bottom opening for receiving nails through the side or bottom opening and discharging them through the longitudinal opening to allow continuous magazine feeding of the fasteners.

One further feature of my invention involves the use of a plurality of radially positioned piston/cylinders combination coupled to the moving head to produce hydraulic forces in a manifold which is in communication with a central piston cylinder combination in which the piston rod acts as a driving blade for driving a nail responsive to movement of the head.

And still another feature of this invention employs a rod and saddle member combination which couples the moving head to the pistons without interference with the feeding of sequential nails to the chamber.

Lastly, I have an embodiment of this invention in which a single large cylinder is coupled to the moving head. Preferably the large cylinder is located at the rear of the body.

BRIEF DESCRIPTION OF THE DRAWING

This invention may be more clearly understood from the following detailed description and particularly with reference to the drawing in which.

DETAILED DESCRIPTION OF THE INVENTION

Figure 1:
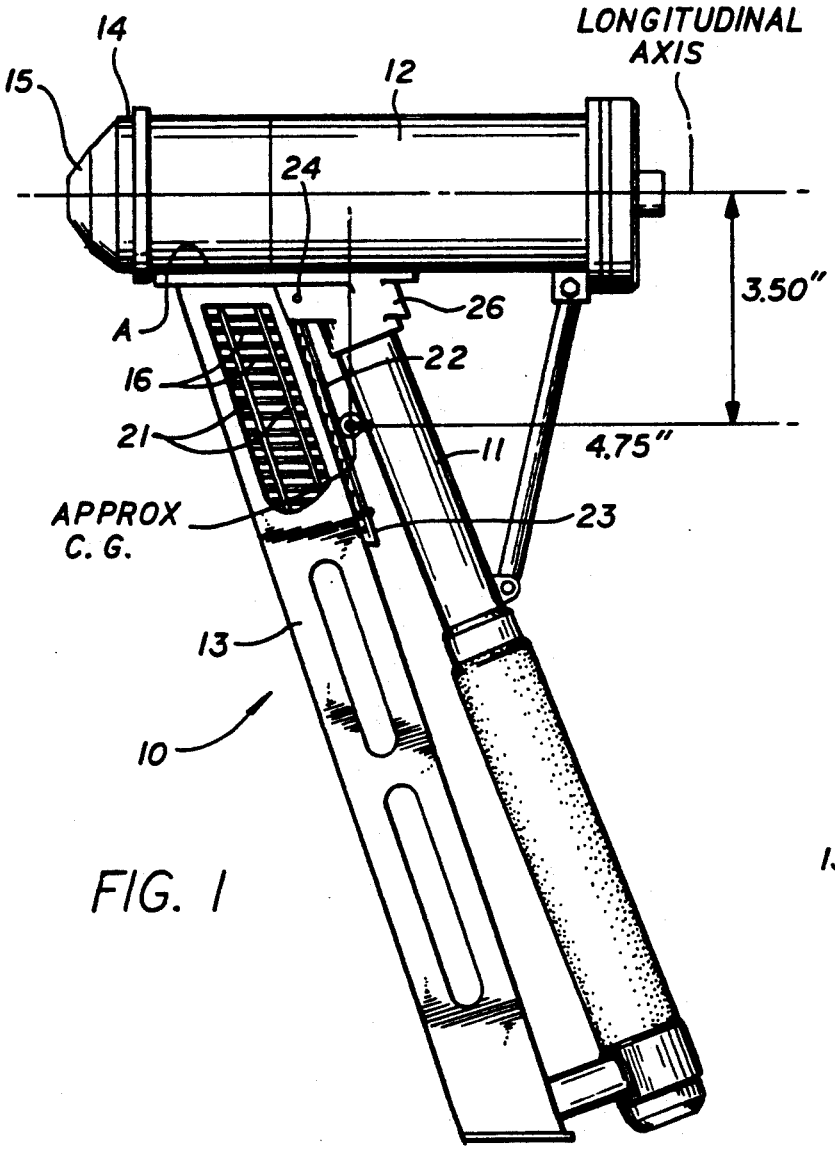
FIG. 1 is a side elevational view of the preferred embodiment of this invention in use.
Figure 2:
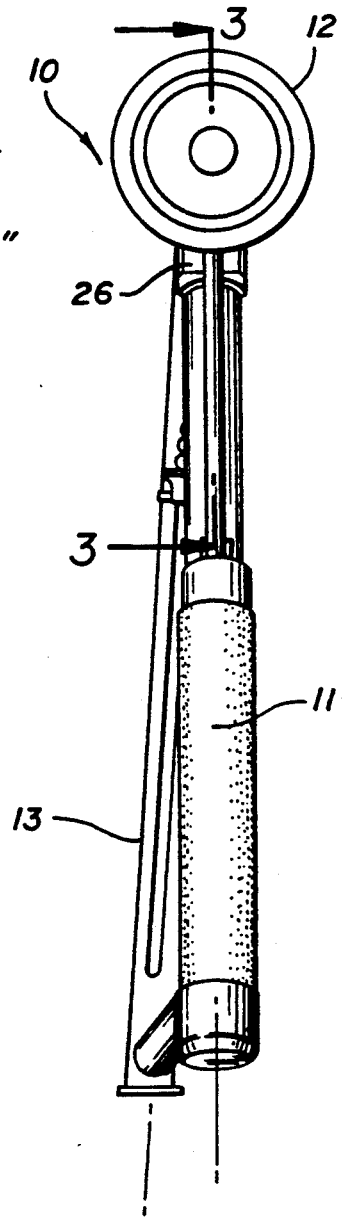
FIG. 2 is a rear elevational view of the hammer of FIG. 1.

Now referring to FIGS. 1–5 of the drawing, my improved hammer, generally designated 10, may be seen including a handle 11 secured to a body 12 at a generally rearward extending angle A by a bracket 26 and providing support for a nail magazine 13. Noticeable at the front of the body 12 is a moving head 14 with a rounded front surface 15 which extends out of the body 12 and has a rearward travel when in use of 0.25 to 0.75 inch while driving nails of 1.0 to 1.75 inch lengths.

Figure 3:
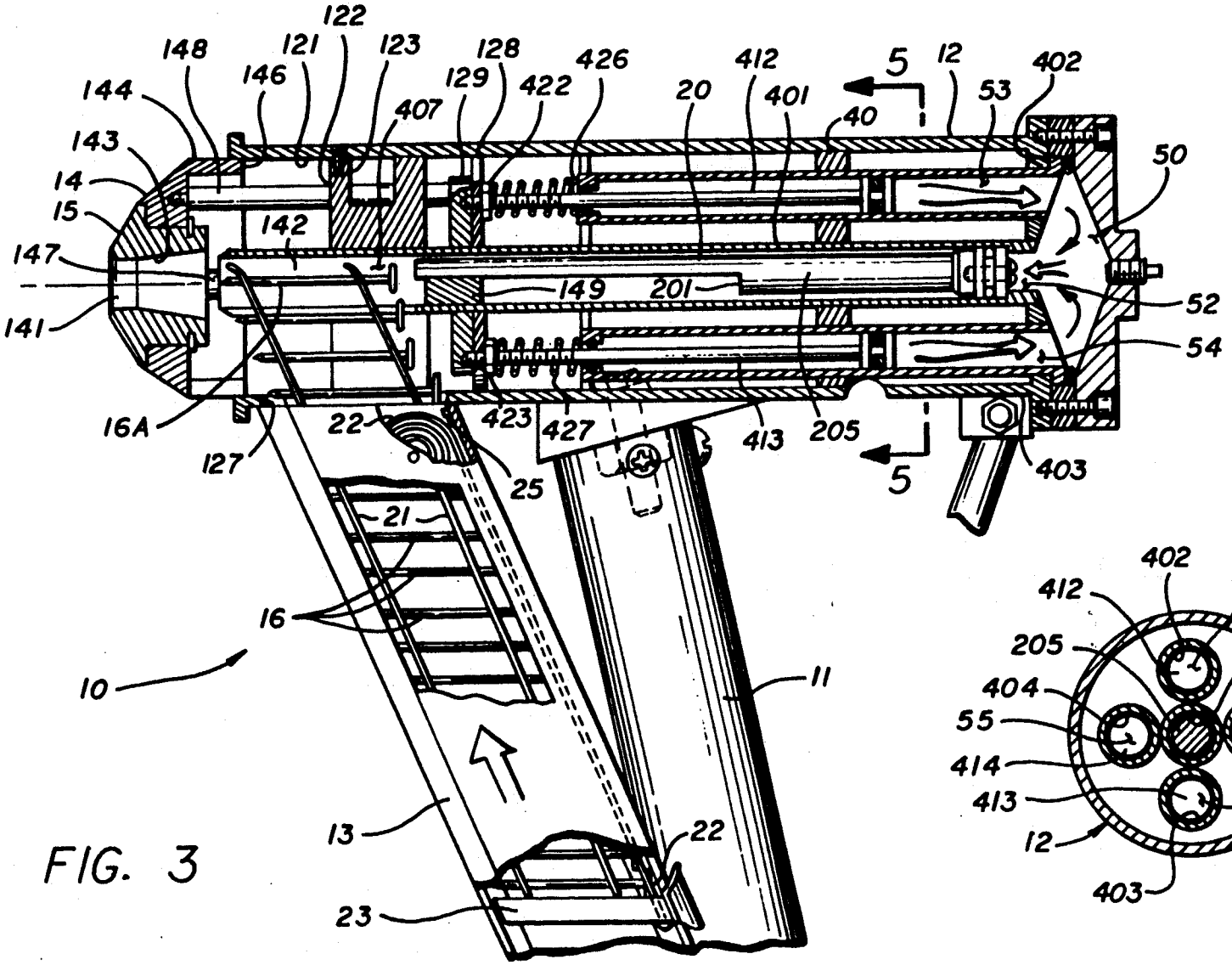
FIG. 3 is a fragmentary front elevational view of the head of hammer of FIG. 1.

The magazine 13 may be seen including side openings which show a typical strip of nails 16 in place, point forward and head positioned to be driven by a drive blade or piston rod 20 of FIG. 3 and located coaxially within the moving head 14. The nails 16 are, typically, secured in a strip of frangible wire or adhesive 21 or by other means as is known in the power air nailing field. The strip of nails 16 is spring biased in the feeding direction as shown by the arrow in FIG. 1 by a helical spring 22 and follower 23.

Note that the handle 11 departs from the conventional right angle with respect to the body 12 and the magazine 13 likewise is angled back with respect to the body 12 and to one side with respect to the handle 11. I have experimented with the handle placement and angle and have found that an angle A as shown in FIG. 1 should be in the range of 95° to 116° for optimum operation. Taking into account the typical length of the user's forearm and the effective length from mid grip to the head, an angle of 95° to 116° from normal to 90° appears to be more effective than 90° and eliminates the common crescent hammer mark on the workpiece made by the head striking at an angle. The magazine 13 is shown offset to the left of handle 11 to provide adequate clearance for a right handed user's hand and for loading fasteners. Similarly, magazine 13 may be offset to the right for left handed tradesmen. The handle 11 is also secured to the head 12 by brace 17 which also serves as a hook for hanging the hammer on a wall or on a tradesmen's belt.

As may be seen in FIG. 3, the helical spring 22 is wound about a pin 24 in recess 25 within the magazine 13. When helical spring 22 is extended toward the bottom of the magazine 13 by grasping the follower 23 and pulling it downward, a strip of nails may be inserted in the magazine 13, the follower 23 released and the spring action drives the follower upward providing a biasing force on the nails, similar to the feeding of a cartridge in a handgun clip. The spring 22, pin 24, recess 25 and follower 23 are preferably located within the magazine 13 on the rear side of the nails. The spring 22 may be located on the side of this magazine 13.

Figure 4:
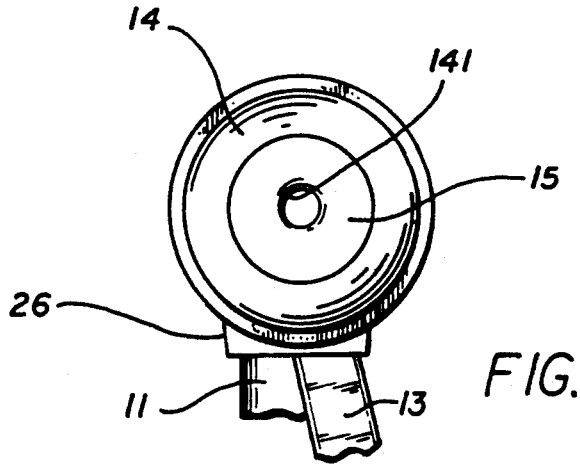
FIG. 4 is a fragmentary front elevational view of this head portion.

Referring now specifically to FIG. 3 in conjunction with FIG. 4, the moving head 14 may be seen as including an axial aperture or opening 141 and an internal recess 142 with a tapered entry 143 which acts as a barrel for ejecting a nail 16A shown in driving position in chamber 407 of a axial nail drive cylinder 401 The moving head 14 includes a circular land or skirt 144 which slides on the inner wall 121 of the body 12. The moving head 14 also includes an interrupted annular rear face 146 which limits rearward travel of the head 14 upon impact of the piston with a surface such a sheet of sheet rock, roofing, plywood or other nailable surface by engaging internal stop 122.

The moving head 14 has a cutout at the bottom of the skirt 144 to afford clearance for fasteners 16 during its rearward travel. Similarly, the body 12 has a rectangular cutout 127 and cylinder 401 for the drive blade or piston rod 20 has a chamber 407 for passage of fasteners 16A, 16B, etc. from the magazine into the chamber 407 of nail drive cylinder 401.

Figure 5:
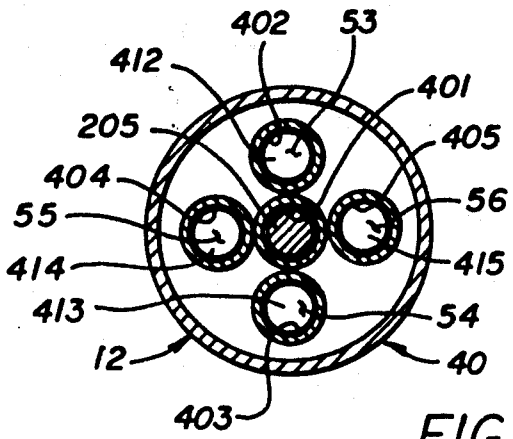
FIG. 5 is a transverse sectional view taken along line 5—5 of FIG. 3.

Positioned behind the nail 16A in FIG. 3 is the drive blade 20 which includes a circular piston rod section 205 as indicated in FIG. 3 with a semicircular section 201 which acts as a drive blade. A forward movement limiting stop 149 is located within a main nail drive cylinder 401. The nail drive blade 20 with its aligned piston 205 travels in the axial cylinder 401 in multi-cylinder block 40, best seen in FIGS. 3 and 5. Behind cylinder block 40 is a manifold 50 including in the preferred embodiment, a total of five ports:

(a) port 52 communicating with the cylinder 401 of the main drive piston 205;

(b & c) ports 53 and 54, shown in both FIGS. 3 and 5 which communicate, respectively, with cylinders 402 and 403, respectively, in multi-cylinder block 40; and (d & e) two additional ports 55 and 56, unshown in FIG. 3 which communicate with cylinders 404 and 405, respectively, which appear in FIG. 5.

Cylinders 402–405 each include respective pistons 412–415 which are driven rearward by rearward movement of the moving head 14 upon impact with a surface transmitted through the rods of pistons 412–415 to manifold 50 which, in the preferred embodiment, is double conical in shape. The manifold 50 allows the reversal of direction of the flow from rearward responsive to movement of the pistons 412–415 to forward movement causing piston 201 to drive the drive blade 20 forward and to set the nail 16A and, in the case of sheet rock installation, in the process to dimple the region of the sheet rock around the nail 16A.

The multiple pistons 412–415, driven by the moving head 14, produce high velocity forward movement of the drive blade 20 for a greater distance than the movement of the body 12 and therefore effective driving of nails.

Thus the device is self powered, i.e., all nail driving power comes from the kinetic energy of the moving hammer. Nail feeding power comes from the energy stored in the spring 22 as each strip of nails is inserted into the magazine 13.

This hammer may be used where external power is unavailable with all of the advantages of automatic feed of nails and effective nail placement by arm power alone.

One of the features of this invention which makes it possible to use four pistons symmetrically located around the drive blade or piston rod 20 while still allowing magazine feed, may be seen in FIG. 3 in conjunction with FIG. 5. The four pistons 412–415 surround the drive blade or piston rod 20 and cylinder 401 providing symmetrical flow in manifold 50 and into port 52.

The pistons 412–415 are each secured at their outer ends to a movable saddle member 128 by threaded engagement and lock nuts of which locknuts only 422 and 423 appear in the drawing, namely in FIG. 3.

A plurality of springs surround respective piston rods 412–415 of which only springs 426 and 427 appear in the drawing, FIG. 3 and are compressed between the saddle 128 and the ends of the respective cylinders 402–405 on each blow. They serve to return the head 14 to its start position after each blow.

Saddle 128 includes a backing plate 129 to which three drive rods 147–149 are threadably secured at the 12, 3 and 9 o'clock positions when viewed from the left in FIG. 3. The drive rods 147–149, of which only rods 147 and 148 (9 and 12 o'clock positions) appear in FIG. 3 extend through a guide block 123 and are threadably secured to the head 14. Drive rod 147 is directly behind the nail 16A in FIG. 3. There is no drive rod in the 6 o'clock position to provide clearance for nail feed from the magazine 13 below the body 12.

By means of the side wall or bottom cutout in the head 14, the opening 127 in the body 12, the chamber 407 in cylinder 401, and the missing drive rod at the 6 o'clock position, a clear opening for strip fed nails is maintained without interference with the drive mechanism. The saddle member 128 transmits the movement of head 14 to all four cylinders 402–405.

It must be recognized that I have found four small cylinders surrounding the nail drive cylinder 401 to be practical and preferred. A different number of cylinders may be used. I have used 0.375" inside diameter cylinders for cylinders 402–405 and the same diameter for the nail drive cylinder 401. This produces a 4:1 travel amplification. If head 14 travels 0.5", the drive blade 20 travels approximately 2.0".

Of course, a different number of pistons than four may be used so long as their placement will serve to clear the fastener feed openings 127 and chamber 407.

I have recognized that the rear face of the head 14 may act within the body 12 in place of the four pistons 412–415 in their respective cylinders 402–405. However, the problems of maintaining effective sealing of the head 14 to the body 12 which then would act as a cylinder initially applied to present reliability problems. Therefore, the embodiment of FIGS. 1–5 is preferred. I have since developed the embodiment of FIGS. 10 & 11 which employ a single cylinder/piston assembly coupled to the moving head and this embodiment is described below in connection with FIGS. 10 & 11.

I have found that an ideal weight for this hammer is between 25 and 38 ounces with the center of gravity located as shown in FIG. 3.

The location of the center of gravity in the above range results in effective driving with a minimum of strain on the arm muscles of the user.

The body 12 being connected to the handle at angle A rather than normal to the handle as in most hammers, appears awkward. However, the angle A, in fact, aids in the moving head 14 striking the workpiece normal to its surface and maximizing the energy directed on the head of the nail resulting in more effective fastening with less tiring operation for the user.

Figure 6:
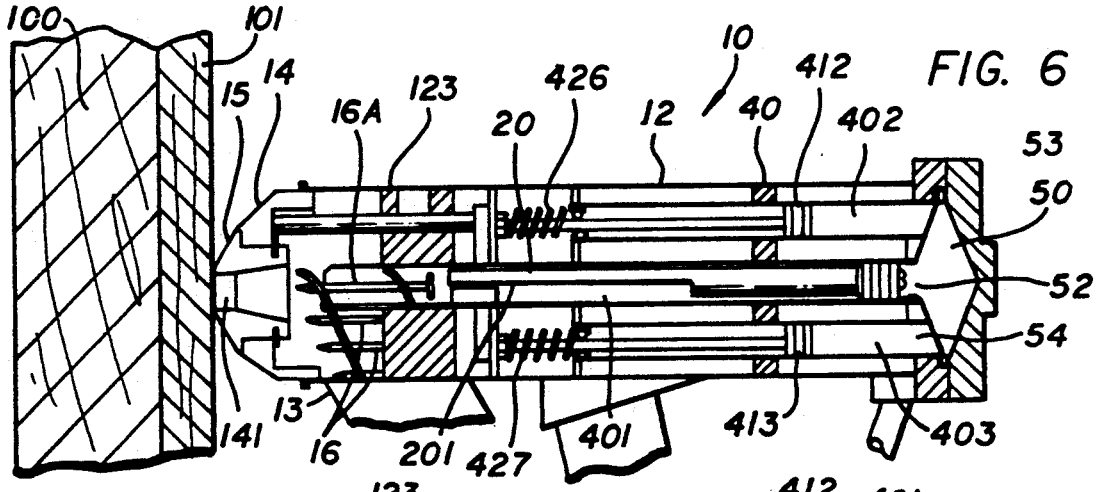
FIGS. 6–9 are simplified schematic views of the hammer of this invention in operation.

The driving sequence is illustrated in schematic diagrams of FIGS. 6–9 in which FIG. 6 shows the hammer 10 in simplified form, in motion, as indicated by the line arrow toward a work surface including a base such as a structural member 100 with an overlying panel 101. In this condition with nails 16 loaded, the hammer is ready for driving the fastener 16A. The moving head 14 had just contacted the work surface represented by the panel 101.

Figure 7:
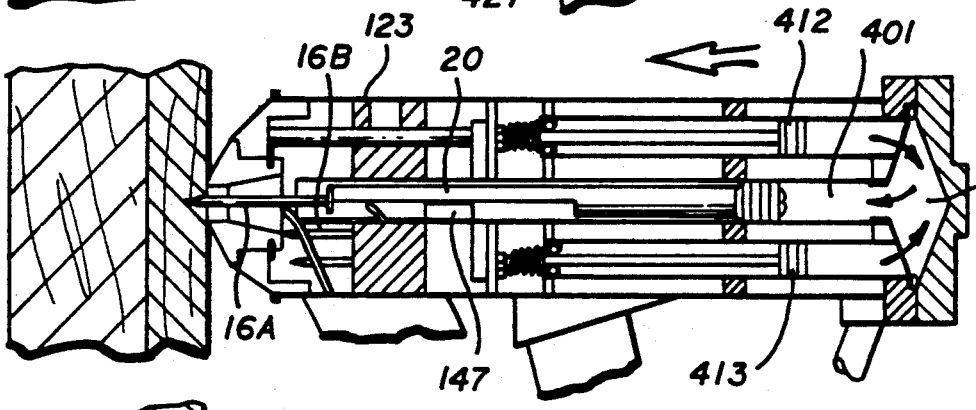

FIG. 7 shows the hammer in contact with the panel 101 and the moving head 14 partially driven rearward into the body 12. The moving head 14 has partially driven the pistons 412 and 413, as well as their unshown counterparts 414 and 415, rearward. Hydraulic fluid flows out of the cylinders 402–405 into manifold 50 and then into the main nail drive cylinder 401 to force the drive blade 20 forward, severing nail 16A from the series of nails 16 and driving it forward through the opening 141 into the workpiece.

Figure 8:
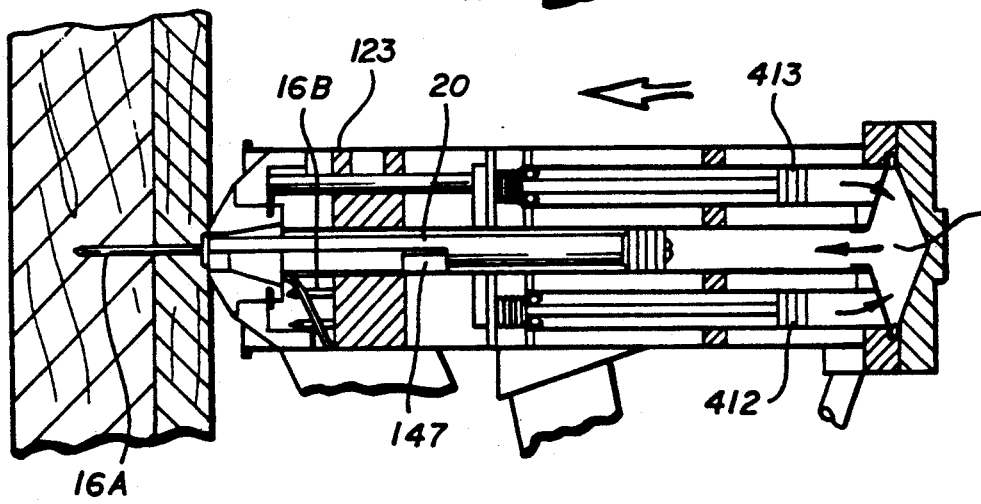
Figure 9:
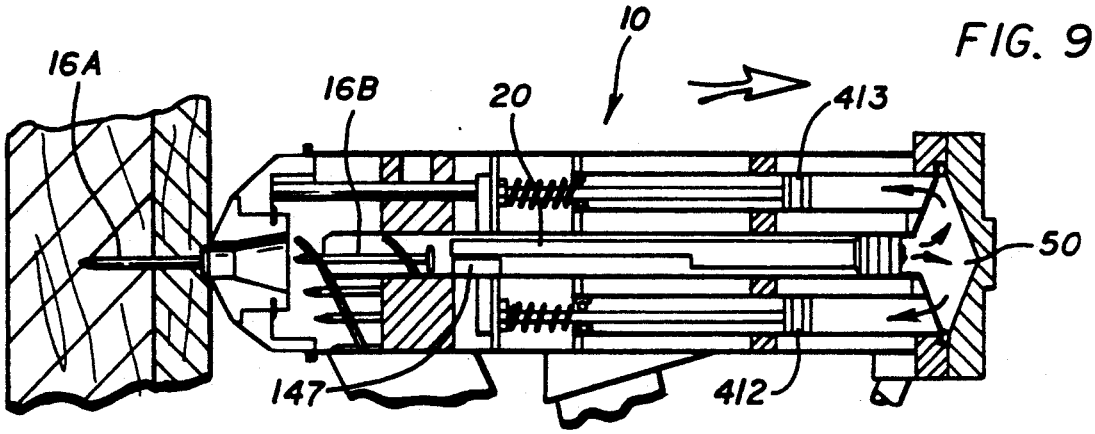

FIG. 8 shows the hammer of this invention in the process of setting the nail 16A. The drive blade 20 has advanced fully forward setting the nail 16A. If the panel 101 is softer such as drywall, the head 14 will have dimpled the surface around the fastener 16A.

As the hammer 10 is withdrawn from contact with the work surface, internal springs 426–429 return the pistons 412–415 to their armed positions. The pressure differential between the exterior and interior of cylinder 401 causes the main drive blade or piston rod 20 to return to its armed position. The helical spring 22 of the magazine, unshown in FIGS. 6–9 causes the next nail 16B to be advanced into the chamber position for the next driving stroke.

Figure 10:
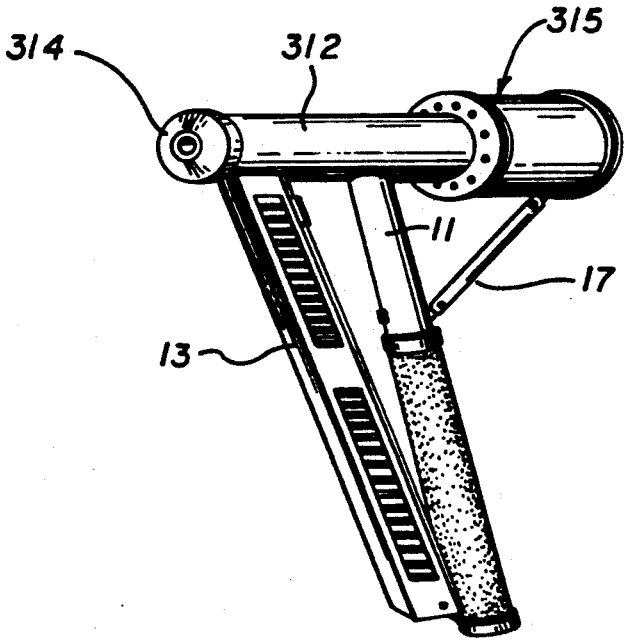
FIG. 10 is a perspective view of a rear piston embodiment of this invention.
Figure 11:
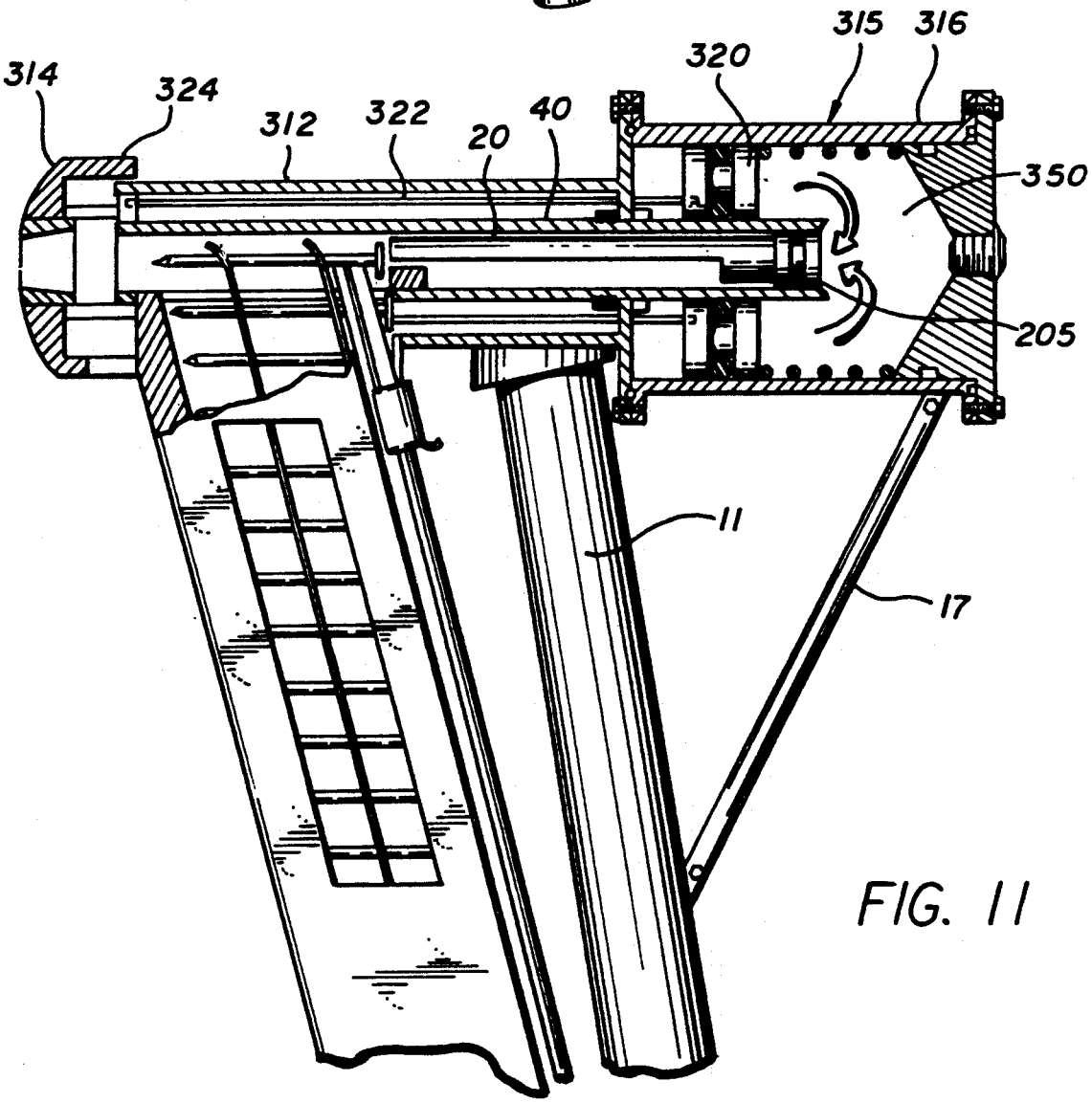
FIG. 11 is a simplified longitudinal sectional view of the embodiment of FIG. 10.

Now referring to FIGS. 10 and 11, another embodiment includes a single large cylinder at the rear of the body 312 coupled to the moving head 314. Each of the elements of FIGS. 10 and 11 which correspond to those of FIGS. 1–9 employ the same reference numeral. New or different elements are numbered in the 300 series. Body 312 is smaller in diameter than body 12 of FIGS. 1–9, for example 1.25" to 3.00" in diameter. Similarly in moving head 314 has a diameter of 1.5" to 1.75".

At the rear of the body 312 is an enlarged cylinder/-piston assembly 315 including a cylinder wall 316 and piston 320. The cylinder/piston assembly is coaxial with and surrounding the nail driving cylinder 40 and drive blade/piston rod 20.

The piston 320 is coupled to the head by a plurality of elongated rods 322, for example, 3 in number as in FIGS. 1–9. One rod 322 appears in FIG. 11. Note also in FIGS. 10 and 11 that the moving head includes an outer skirt 324 which extends rearward over the body 312 thereby preventing any contact of the body 312 with the work surface.

The entire rear portion of the cylinder 315 acts as a manifold 350. In this embodiment the single piston 320 has an area several times greater than the area of the piston 205 so the travel of blade 20 will be greater by the area ratio. As example:

| | |
|---|---|
| Diameter of Piston 205 | ⅜" |
| Diameter of Piston 320 | 1½" |
| Area ratio D320/D205 | 16 |
| Travel of head 314 | 3/16" |
| Travel of piston 20 | 3" |

Employing my invention as illustrated in the drawing FIGS. 1–5, I have successfully driven the following types of nails:

| | |
|---|---|
| drywall | 1" to 1⅛" |
| roofing | 1" to 1⅛" |
| 4d, 6d, and 8d | 1" maximum |

The embodiment used in demonstrating this invention has the following characteristics:

| | |
|---|---|
| overall dimensions of the body: | 9" |
| length of handle: | 15½" |
| overall weight: | approx. 3 lbs. |
| drive cylinder 201 inside diameter: | 0.375" |
| drive blade 20 stroke: | 2.0" |
| cylinders 402–405 inside diameter: | 0.375" |
| pistons 413–416 stroke: | 0.430" |
| hydraulic fluid used: | Hydraulic Jack Oil |
| magazine capacity: | 50 |
| materials used: | |
| body 12: | T-6 6061 Al |
| head 14: | T-6 6061 Aluminum with a 304 Stainless Steel insert |
| driving blade: | 304 Stainless Steel |
| pistons | 304 Stainless Steel |
| handle: | T-6 6061 Al |

The foregoing describes the best mode known by me for carrying out my invention. The specific embodiment is illustrative, however, and is not to be considered as limiting. It is recognized that a worker or ordinary skill in the hammer art may make embodiments which have a different appearance yet fall with in my concept. Therefore, the scope of this invention must not be considered as limited to the embodiment shown but rather by the invention as defined by the following claims including the protection afforded by the Doctrine of Equivalents.

What is claimed is:

1. A self powered hammer comprising a handle, a fixed body secured to said handle;

said fixed body including a cylindrical recess at one end thereof having a longitudinal axis;

a generally cylindrical movable striking head in reciprocal moving relationship along the axis of said body partially extending into the cylindrical recess in said body said head including a passageway along said axis;

means normally urging said movable head outward from said body;

a manifold within said body behind said movable head; and hydraulic fluid filling said manifold;

said body including a first cylinder in said recess positioned along said axis, a nail holding chamber forming part of said cylinder, a first piston and a nail driving blade in said cylinder aligned with said passageway, an opening of said chamber exposed to the exterior of said body through said passageway; and a second cylinder and a second piston in said body operatively connected to said head and to said manifold whereby striking the movable head member against a surface generates hydraulic pressure within said manifold communicated to said first piston for driving said first piston toward said head and for driving a nail through said passageway into a work surface.

2. A hammer in accordance with claim 1 wherein said head urging means comprises resilient means within said fixed body for returning said striking head to a normal at rest position at the end of each blow.

3. A combination in accordance with claim 1 wherein said body includes an opening therein for receiving nails behind said head.

4. A hammer in accordance with claim 1 including a plurality of said second pistons and cylinder placed around said first cylinder.

5. A hammer in accordance with claim 1 wherein a plurality of said second cylinders and pistons are coupled to said head for piston movement displaced from and parallel to said longitudinal axis; and said body includes a nail receiving path extending generally normal to said longitudinal axis and behind said head whereby nails are movable into said chamber without interference with longitudinal movement of said head.

6. A hammer in accordance with claim 5 wherein said plurality of second pistons and cylinders are radially disposed with respect to the axis of said head for fluid moving movement parallel to the axis of said body; and said body includes a peripheral recess for receiving nails to be driven.

7. A hammer in accordance with claim 6 wherein said plurality of second pistons and cylinders have a total piston working area several times the working area of said first piston.

8. A hammer in accordance with claim 1 wherein said nail driving blade includes an end surface for driving a nail; and a side surface of said blade is recessed to pass the next adjacent nail in a strip of connected nails.

9. A hammer in accordance with claim 1 wherein said body includes an opening therein communicating with said chamber for introducing nails into said body behind said head and in position to be driven by said first position.

10. A hammer in accordance with claim 9 including a self feeding magazine for nails secured to said head and extending generally in the same direction as said handle extends from said body.

11. A hammer in accordance with claim 10 wherein the magazine extends to one side of said handle.

12. A hammer in accordance with claim 1 wherein said handle is secured to said body and extends at an angle with respect to said longitudinal axis of said body of between 95 degrees and 116 degrees rearward relative to the working face.

13. A hammer in accordance with claim 12 wherein said handle extends rearward from said movable striking head.

14. A hammer in accordance with claim 12 wherein the center of gravity of the hammer is located at a point behind the point at which said handle is secured to the body.

15. A hand powered hammer in accordance with claim 1 wherein a plurality of rods couple said moving head to said second piston, said rods extending parallel to said longitudinal axis and surrounding said first cylinder.

16. A hand powered hammer in accordance with claim 1 including an opening in the wall of said body behind said moving head and means for sequentially advancing nails through said opening into position for driving by said nail driving blade.

17. A hand powered hammer for driving nails into a workpiece comprising:

a handle;

an elongated body attached to said handle, said body having a cylindrical recess therein having a longitudinal axis and including a generally cylindrical striking head at one end thereof and linearly movable along the axis of said recess, a passageway through said striking head along said axis, first cylinder in said body positioned along said axis, a piston and drive blade member in said first cylinder in alignment with said passageway;

second cylinder and a piston in said second cylinder having an operative connection to said striking head, a manifold communicating with said piston and drive blade member and said piston, and hydraulic fluid filling said manifold; and a nail magazine fastened to said body, a nail receiving chamber in said first cylinder and means urging nails from said magazine into said chamber;

such that striking said striking head against said workpiece displaces said piston causing hydraulic pressure to be applied against said piston and drive blade member to drive a nail from said chamber into said workpiece;

a plurality of said second cylinders each with a respective piston and rod, said piston rods and cylinders being arranged in parallel relationship to each other and the longitudinal axis of said moving head for direct action responsive to movement of said moving head and wherein said piston and drive blade member extends parallel to said plurality of cylinders for movement in a nail driving direction.

18. A hand powered hammer for driving nails into a workpiece comprising:

a handle;

an elongated body attached to said handle, said body having a cylindrical recess therein having a longitudinal axis and including a generally cylindrical striking head having a rounded striking surface for contacting said workpiece at one end of said recess, said striking head being linearly movable along the axis of said recess, a passageway through said striking head along said axis, first cylinder in said body positioned along said axis and a first piston and a drive blade in said first cylinder in alignment with said passageway;

a second cylinder and an enlarged diameter chamber in said second cylinder at the opposite end of said body from said striking head and a second piston in said enlarged diameter chamber having a diameter substantially greater than the diameter of said cylinder recess a means connecting said second piston to said striking head, said connecting means extending parallel to said longitudinal axis and surrounding said first cylinder a manifold communicating with said first piston and said second piston, and hydraulic fluid filling said manifold; and a nail magazine fastened to said body, a nail receiving chamber in said first cylinder and means urging nails from said magazine into said chamber;

such that striking said striking head against said workpiece displaces said second piston causing hydraulic pressure to be applied against said first piston and drive blade to drive a nail from said chamber into said workpiece.

* * * * *